US005950472A

United States Patent [19]

Grotnes et al.

[11] Patent Number: 5,950,472

[45] Date of Patent: Sep. 14, 1999

[54] BEAD-FORMATION IN METAL DRUM MANUFACTURE

[75] Inventors: Carl C. Grotnes, Atlanta; Kenneth R. Babcock, Marietta; Archie Tan, Roswell, all of Ga.

[73] Assignee: Atlanta Grothes Machine Company, Atlanta, Ga.

[21] Appl. No.: 09/133,268

[22] Filed: Aug. 13, 1998

[51] Int. Cl.[6] ..... B21D 15/06

[52] U.S. Cl. ..... 72/105; 72/393

[58] Field of Search ..... 72/105, 106, 110, 72/393

[56] References Cited

U.S. PATENT DOCUMENTS

| | | | |
|---|---|---|---|
| 1,782,994 | 11/1930 | Lindgren | 72/106 |
| 1,908,521 | 5/1933 | Lindgren | 72/105 |
| 2,089,476 | 8/1937 | Grotnes | 72/393 |
| 4,487,048 | 12/1984 | Frei | 72/105 |
| 5,212,866 | 5/1993 | Wenzel et al. | 72/105 |

*Primary Examiner*—Lowell A. Larson

*Attorney, Agent, or Firm*—Howson & Howson

[57] ABSTRACT

Apparatus for forming beads in the cylindrical wall of a metal drum blank comprising a die head and an opposed roller, for engaging the interior and exterior surfaces, respectively, of a cylindrical drum blank. The die head has first, second and third coaxial, circular dies, each made up of plural, wedge-shaped die elements. The roller has two coaxial peripheral edges cooperable with the dies to form a W-style bead. The second die is located between the first and third dies and is radially expansible, by the frusto-conical surface of a cam, for producing a standard bead. The same frusto-conical surface also expands the first die, and a separate frusto-conical surface expands the third die. Lands on the cam engage the wedge-shaped elements of the first and third dies and maintain the first and third dies at fixed radial positions in engagement with the inner cylindrical wall of a drum blank, while the cam continues to urge the wedge-shaped elements of the second die radially outwardly. The die head optionally includes a fourth circular die spaced axially from, but coaxial with, the first, second and third dies, and a second roller opposed to, and cooperable with, the fourth die for forming a reduced neck in a drum blank.

10 Claims, 5 Drawing Sheets

BEAD-FORMATION IN METAL DRUM MANUFACTURE

SUMMARY OF THE INVENTION

This invention relates to the manufacture of metal drums, for example the common 55 gallon steel drum used for the transportation and storage of a wide variety of substances including solvents and other chemicals, lubricants, fuels, etc. It relates more particularly to an apparatus and process for forming beads in the cylindrical wall of a drum.

In accordance with industry standards, metal drums made in the U.S.A. have two beads located respectively at approximately one-third and two-thirds the height of the drum. These beads not only serve as reinforcements, but also facilitate rolling of the drum. In the case of a drum having a removable head, the beads protect the removable head from damage while the drum is being rolled.

Two general types of beads are used. One is the standard bead, also known as a "rolling hoop," which projects outwardly. It is customarily formed by an expanding die. Another type of bead is the "W" style bead, which consists of a central, outwardly projecting section between two inwardly projecting sections. The "W" style bead is customarily formed in a machine known as a "corrugator," by rotating the drum while pressing cooperating bead-forming rolls, in opposed relationship to each other, against its inner and outer surfaces.

To meet the demand for the two different styles of bead, it has been necessary for a drum producing facility to have two separate machines, one to form the standard bead, and the other to form the "W" style bead. The need for two separate machines entails a large expenditure for the machines themselves, for the space required to house them, and for their maintenance. Moreover, the demand for the different styles of bead varies, and consequently it is not unusual for one or the other of the machines to be idle.

The principal object of this invention is to provide a simple and more versatile bead-forming machine, which is capable of forming beads of both types, thereby significantly reducing the expenditures required to set up and operate a drum producing facility.

The bead-forming apparatus in accordance with the invention comprises a die head and an opposed roller, for engaging the interior and exterior surfaces of a cylindrical drum blank. The die head and roller are configured to form a W-style bead, the die head comprising first, second and third coaxial dies. The second die is situated between the first and third dies and is radially expansible so that it can also be used to produce a standard bead.

Other objects, details and advantages of the invention will be apparent from the following detailed description when read in conjunction with the drawings.

DETAILED DESCRIPTION

Figure 1:
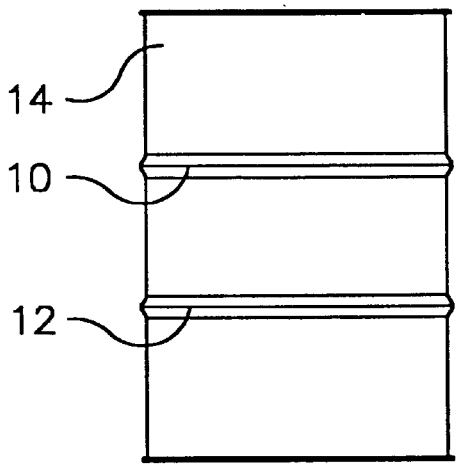
FIG. 1 is an elevational view of a conventional 55 gallon steel drum, having standard, outwardly projecting beads.
Figure 2:
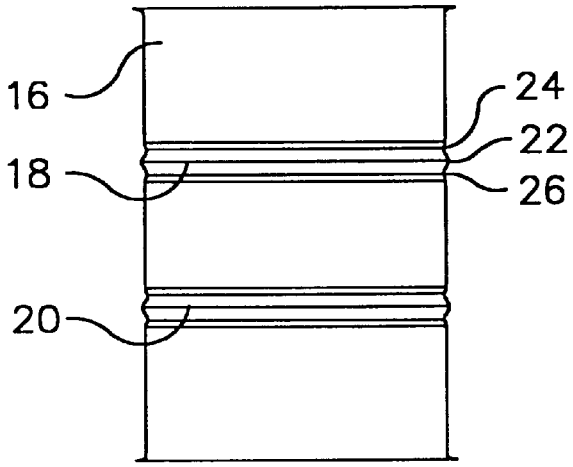
FIG. 2 is an elevational view of a 55 gallon drum having W-style beads.

The bead-forming machine of this invention is capable of forming both standard and W-style beads in the cylindrical wall of a drum blank. These beads are typically located at approximately ⅓ and ⅔ of the height of the drum 14. The standard bead is an outwardly projecting bead as shown at 10 and 12 in FIG. 1. W-style beads are shown in FIG. 2, on drum 16, at 18 and 20. The W-style bead is a corrugation consisting of an outwardly projecting part 22 between two inwardly projecting parts 24 and 26. The outwardly projecting part extends outwardly beyond the outer diameter of the cylindrical part of the drum.

Figure 3:
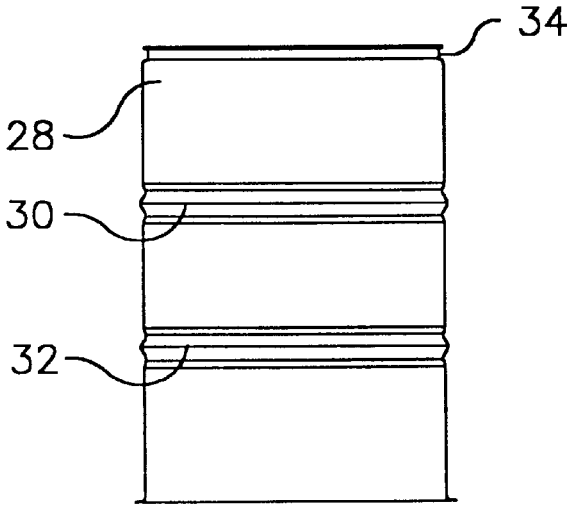
FIG. 3 is an elevational view of a 55 gallon drum having W-style beads and a "necked-in" head.

Drum 28 in FIG. 3 has two W-style beads 30 and 32, and a reduced-diameter, or "necked-in," part 34 at its upper end. The necked-in part enables the drum to receive a removable head (not shown) having a diameter less than that of the outwardly projecting parts of the W-style beads, and therefore avoids dislodging, and damage to, the removable head when the drum is rolled on its beads.

Figure 4:
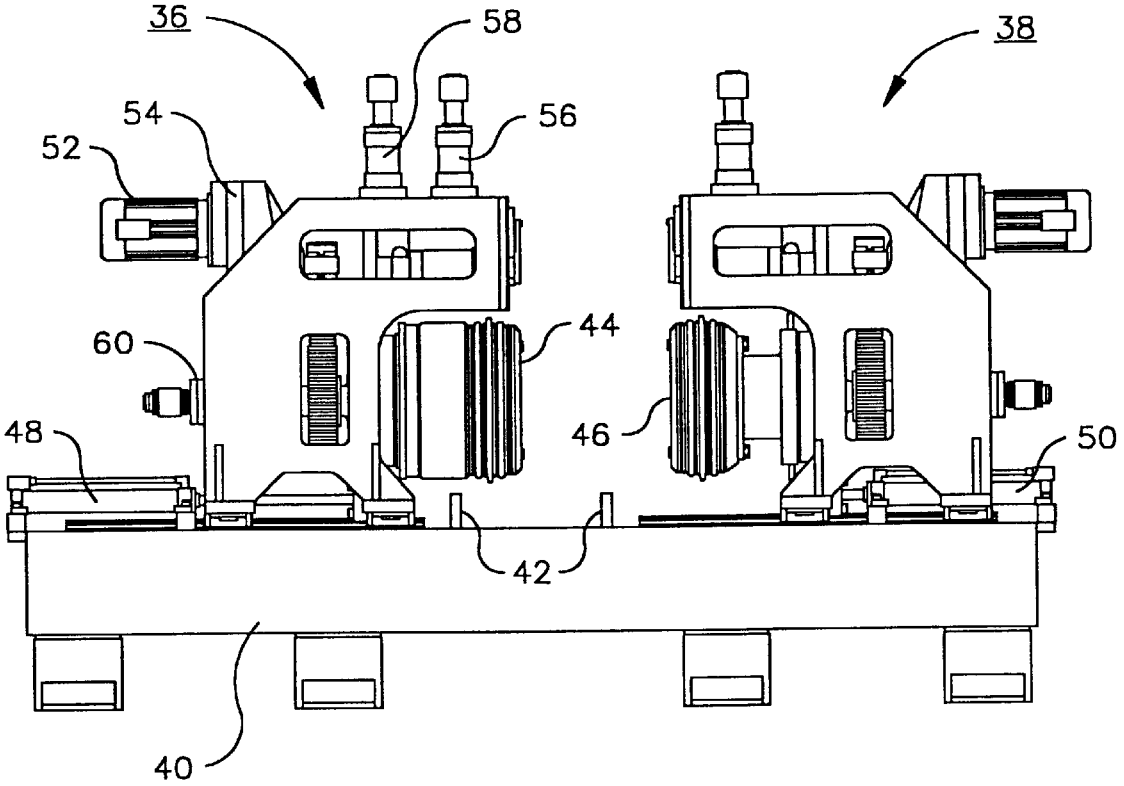
FIG. 4 is a front elevation of a bead-forming machine in accordance with the invention.

The bead-forming machine, as shown in FIG. 4, comprises two opposed bead-forming assemblies 36 and 38, track-mounted on a bed 40. These bead-forming assemblies can be identical. However, in a preferred embodiment, as shown in FIG. 4, the left-hand bead-forming assembly includes a die and roller for forming the necked-in part of the drum, as described above. Drum supports 42, at an intermediate location on the bed, hold a drum blank (not shown) in a position in which it is axially aligned with die heads 44 and 46 on the respective bead-forming assemblies. Hydraulic actuators 48 and 50 move the die heads longitudinally on the bed so that the die heads can enter the drum. Both beads are usually formed simultaneously. However, even if only one bead is formed, both dies will ordinarily be inserted into the drum to maintain the drum in proper alignment with the dies. As shown in FIG. 4, assembly 36 is in its extended position, while assembly 38 is in its retracted position.

Referring to FIG. 4, die head 44 is rotatable by a motor 52 through reduction gearing in gearbox 54. Hydraulic actuator 56 pushes a roller toward the die head for forming W-style beads, and hydraulic actuator 58 pushes a roller toward the die head for formation of a necked-in part of the drum. A pair of hydraulic actuators 60 and 62, shown in FIG. 5, control the expansion of the dies.

Figure 6:
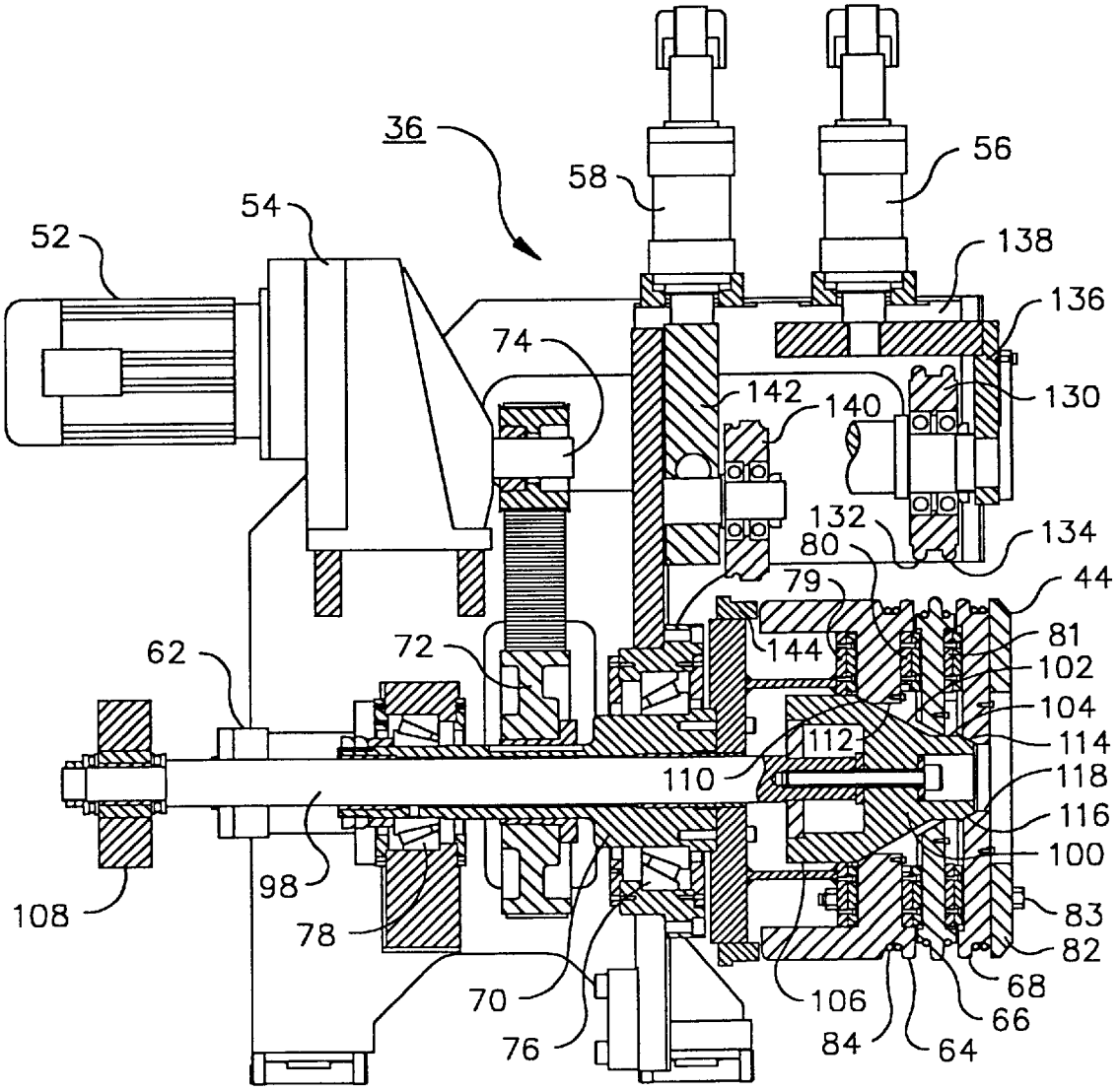
FIG. 6 is a fragmentary sectional view showing details of the die head and roller of the machine, and also illustrating a feature for forming the necked-in head of FIG. 3.

Referring to FIG. 6, die head 44 comprises three coaxial, circular dies 64, 66 and 68, each having a rounded, peripheral, drum-contacting edge. Each of the three dies comprises plural, wedge-shaped sections which are radially movable for expansion. The die head is mounted on a hollow shaft 70, on which a keyed gear 72 is driven, through a gear train, by the output shaft 74 of gearbox 54. The shaft 70 is rotatably supported by roller bearing assemblies 76 and 78. The die head comprise a set of die "tables" 79, 80 and 81, which are in the form of rings secured to one another, and to a ring-shaped end plate 82 by bolts, one of which is shown at 83. The spacing of the die tables is maintained by spacers (not shown) surrounding the bolts. The bolts and their surrounding spacers extend through clearances in the dies.

The die elements are urged radially inward by surrounding springs, for example springs 84 on die 64.

Figure 8:
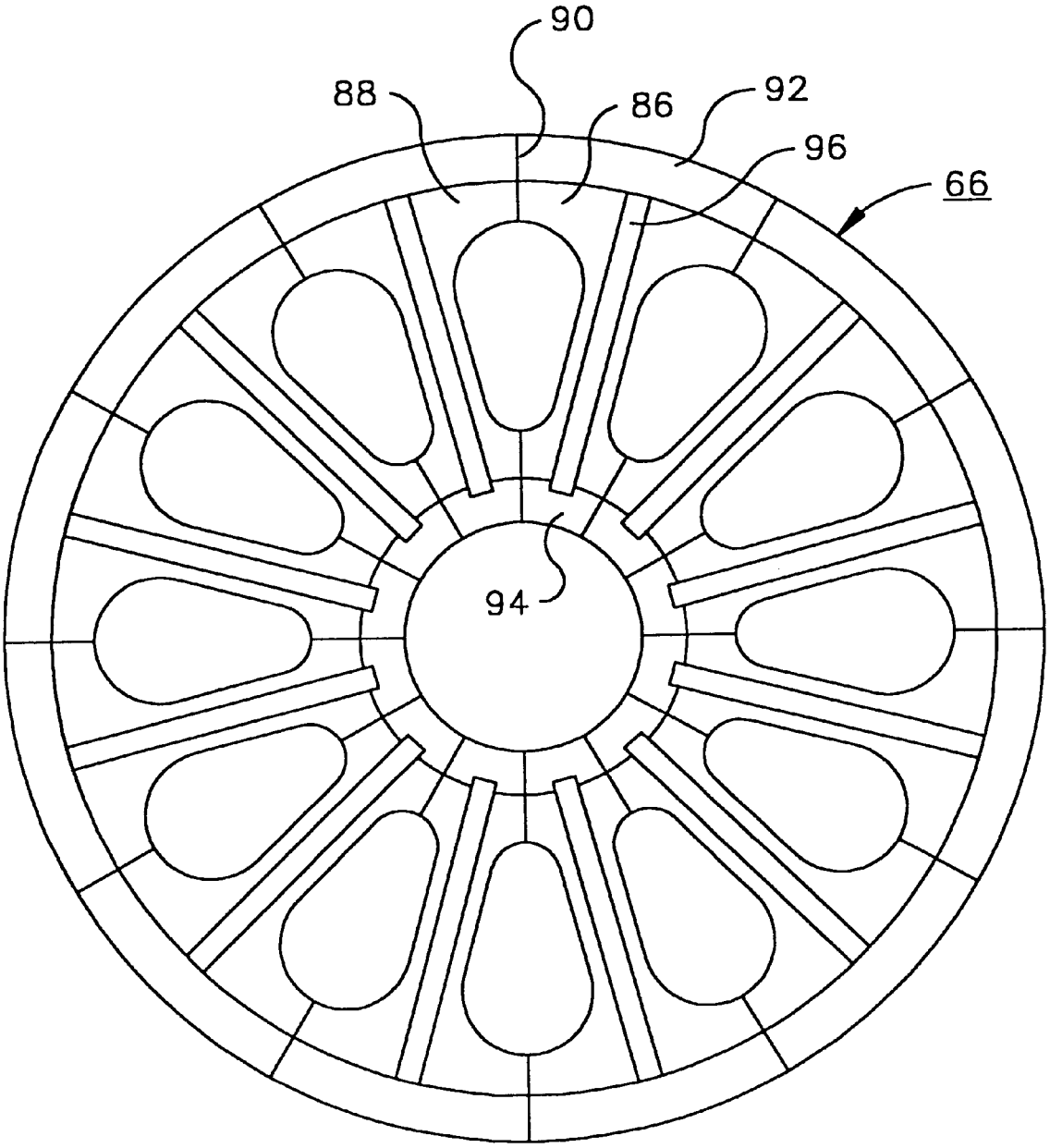
FIG. 8 is an elevational view of the intermediate die of FIG. 7.

The dies are similar in structure, and only die 66 will be described in detail. As shown in FIG. 8, die 66 is made up of twelve wedge-shaped elements. Two such elements, labeled 86 and 88, meet at a radial interface 90 when the wedge-shaped elements are in their radially inmost position. As illustrated by element 86, each wedge-shaped element has an rounded, bead-forming periphery 92, an inner surface 94 in the form of a sector of the frustum of a cone, and a radial guide slot 96.

Figure 5:
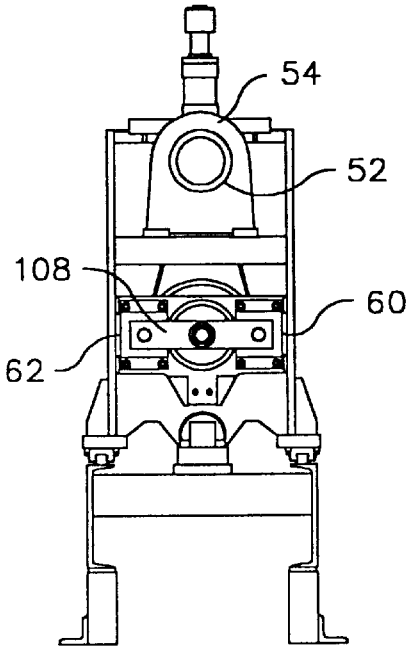
FIG. 5 is an end elevation of the machine, as seen from the left of FIG. 4.

As shown in FIG. 6, a rod 98 extends axially through the hollow space within shaft 70. The rod is keyed to the hollow shaft and rotates with it. Connected at one end of the rod is a cam 100 inside die head 44. This cam has a frusto-conical surface 102, and small and large cylindrical land surfaces 104 and 106 respectively at the narrow and wide ends of surface 102. The frusto-conical surface 102 of the cam cooperates with the frusto-conical sectors of the wedge-shaped components of die 66, to force the wedge-shaped elements radially outward when rod 98 is moved toward the right by the operation of actuators 60 and 62 (FIG. 5). The rod is rotatable in a bearing in block 108, which is connected to the pistons of actuators 60 and 62.

The frusto-conical surface 102 of the cam also cooperates with frusto-conical sectors 110 of the wedge shaped components of die 64 to urge die 64 radially outward as the cam moves toward the right. However, the outward movement of the components of die 64 stops as the cam moves past frusto-conical sectors 110 and cylindrical inner surfaces 112 of the die components come into engagement with cylindrical land surface 106 of the cam, which maintains the elements of die 64 in fixed radial positions by preventing them from moving radially inwardly.

In a similar manner, as the cam moves toward the right, the cooperation of a frusto-conical surface 114, at its right-most end, with frusto-conical sectors 116 of the elements of die 68 causes these elements to move outwardly until surface 114 clears surfaces 116, at which time, the elements of die 68 are maintained in fixed radial positions, being held against radially inward movement by the engagement of their cylindrical surfaces 118 with surface 104.

Figure 7:
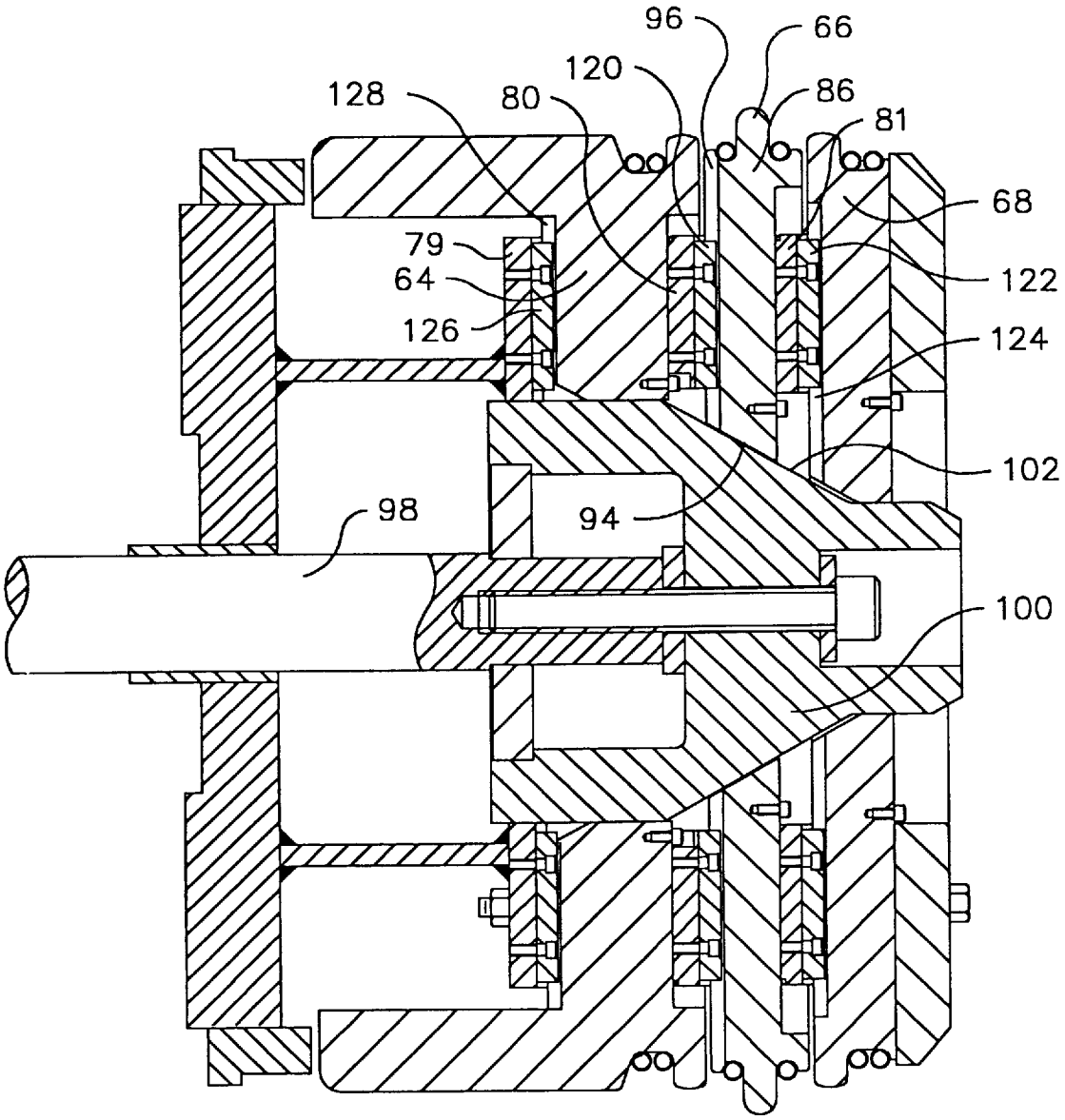
FIG. 7 is a fragmentary sectional view of the die head, showing the manner in which an intermediate die is expanded to form the standard bead, as shown in FIG. 1.

As seen in FIG. 7, a guide block 120, which is bolted to die table 80 fits into slot 96 in wedge-shaped element 86, constraining element 86 to radial movement. In a similar manner, a block 122, bolted to die table 81 fits into radial slot 124 in an element of die 68, for guidance of the elements of die 68, and a block 126, bolted to die table 79, fits into radial slot 128 in an element of die 64. Each of the other wedge-shaped elements of dies 64, 66 and 68 is similarly constrained to radial movement.

After the bead-forming assembly 36 is moved to the right so that the die head 44 enters a drum blank on the drum support, rod 98 moves cam 100 to the right, causing dies 64 and 68 to expand first. However, these dies expand only enough to engage and exert a gripping action on the inside surface of the drum blank. As the cam continues to move to the right, the engagement of its frusto-conical surface 102 with sector 94 on element 86, and with the corresponding sectors on the other wedge-shaped elements of die 66, causes the wedge-shaped elements to move outwardly, as illustrated in FIG. 7, effectively expanding the die 66 for formation of a standard bead.

Referring again to FIG. 6, the bead-forming assembly 36 includes a roller 130, having first and second coaxial, circular drum-engaging peripheral edges 132 and 134. The roller is rotatable on bearings about an axis which is parallel to the axis of the die head 44. The bearings of the roller are mounted on a bracket 136, which is movable vertically by actuator 56 mounted on frame 138 of the bead forming assembly 36.

The roller 130 is positioned so that, by operation of actuator 56, its peripheral edge 132 approaches the space between the rounded peripheral edges of dies 64 and 66. Likewise peripheral edge 134 of roller 130 is positioned to approach the space between the rounded peripheral edges of dies 66 and 68.

In the formation of a W-style bead, the die head is moved into a drum blank as in forming a standard bead, and the dies 64 and 68 are expanded sufficiently to engage and grip the inner wall of the drum blank. Continued rightward movement of the cam 100 causes die 66 to expand further in order to form the central part of the W-style bead. Roller 130 is then pressed inwardly against the outer wall of the drum blank and the shaft 70 is rotated by motor 52 so that the cooperating action of the die head and roller 130 forms the W-style bead.

In forming the W-style bead, the intermediate die 66 is not expanded radially as far as it is expanded for a standard bead. For this purpose, the hydraulic actuators can be stopped in mid-stroke by closure of the valve which controls the flow of hydraulic fluid to them.

Alternatively, stopping of the cam in an intermediate position for W-style bead formation can be accomplished by the use of multi-position actuators or plural actuators connected together.

FIG. 6 also shows a second roller 140 on bearings in a bracket 142, which is movable radially by actuator 58. This roller cooperates with a die 144, which rotates with the die head 44 to produce the necked-in part 34 shown in FIG. 3. The necked-in part of the drum can be formed simultaneously with, or either before or after, the formation of either type of bead.

In the operation of the machine as shown in FIG. 4, both of the beads on a drum can be formed by operating the opposed bead-forming assemblies 36 and 38 simultaneously.

As will be apparent from the preceding description, the invention makes it possible to use a single machine to form both standard and "W-style" drum beads. It is not necessary to have two different types of bead-forming machinery on hand. Moreover, no time is lost in converting over from one bead style to the other.

Various modifications can be made to the apparatus described. For example, instead of making the die heads rotatable, rollers can be made to revolve around nonrotating die heads. All that is required for the formation of the W-style bead is planetary motion of the roller relative to the die head.

The apparatus can be used to produce more than two beads in a drum. For example, after two beads, as shown in FIGS. 1 or 2 are formed, a bead-forming assembly 36 or 38 can be moved axially so that its die is at a different location within the drum for formation of another bead.

Although hydraulic actuators are shown for moving the bead-forming assemblies, it is possible to utilize manually or motor-operated feed screws or similar mechanisms for this purpose. It is also possible to use alternative actuators or manually operated mechanisms to operate the dies and rollers.

Still other modifications may be made to the apparatus and method described above without departing from the scope of the invention as defined in the following claims.

We claim:

1. Apparatus for forming beads in the cylindrical wall of a metal drum blank comprising a die head and an opposed roller, for engaging the interior and exterior surfaces, respectively, of a cylindrical drum blank, the die head having first, second and third coaxial, circular dies and a roller having two coaxial peripheral edges cooperable with the dies to form a W-style bead, the second die being between the first and third dies and being radially expansible for producing a standard bead.

2. Apparatus according to claim 1 in which the second die comprises a plurality of wedge-shaped elements, and including a cam having a frusto-conical surface for urging the wedge-shaped elements radially outwardly.

3. Apparatus according to claim 1 in which each of the three coaxial, circular dies comprises a plurality of wedge-shaped elements, and including a cam having a first frusto-conical surface for urging the wedge-shaped elements of the first and second dies radially outwardly, a second frusto-conical surface for urging the wedge-shaped elements of the third die radially outwardly, lands for engaging the wedge-shaped elements of the first and third dies and maintaining the first and third dies at fixed radial positions while the first frusto-conical surface of the cam continues to urge the wedge-shaped elements of the second die radially outwardly.

4. Apparatus according to claim 1 including a fixed supporting frame, means for rotating said die head, relative to the supporting frame, about an axis with which the die elements are coaxial, and means for mounting said roller on the frame and for moving the roller radially toward said die head while limiting movement of the roller to rotation and radial movement and preventing revolving movement of the roller about said axis.

5. Apparatus according to claim 1 in which the die head has a fourth circular die spaced axially from, but coaxial with, said three coaxial, circular dies, and a second roller opposed to, and cooperable with, said fourth die for forming a reduced neck in a drum blank.

6. Apparatus for forming beads in the cylindrical wall of a metal drum blank comprising:

a die head comprising first, second and third circular dies mounted on a first axis in coaxial relationship to one another for entry into the interior of a drum blank, each die having a drum-engaging periphery, and the drum-engaging peripheries of the dies being spaced axially from one another to provide a first space between the peripheries of the first and second dies and a second space between the peripheries of the second and third dies, the second die being situated between the first and third dies and being radially expansible to a position in which the radius of its periphery is greater than the radii of the first and second dies;

a roller having first and second coaxial, circular drum-engaging peripheral edges spaced axially from each other, the roller being rotatable on a second axis parallel to the first axis and in opposed relationship to the die head so that a portion of a cylindrical wall of a drum blank can be located between the roller and the die head, the first drum-engaging peripheral edge of the roller being positioned on the second axis to approach said first space radially, and the second drum-engaging peripheral surface of the roller being positioned on the second axis to approach said second space radially;

pressing and rotating means for pressing the roller radially inward toward the first axis and for effecting relative planetary movement of the roller about the die head; and expanding means for effecting radial outward expansion of the second die;

whereby, for the formation of a W-style bead, the pressing and rotating means can be operated, and, alternatively, for formation of a standard bead, the expanding means can be operated.

7. Apparatus according to claim 6 in which the second die comprises a plurality of wedge-shaped elements, and in which said expanding means comprises a cam having a frusto-conical surface for urging the wedge-shaped elements radially outwardly.

8. Apparatus according to claim 6 in which each of the three coaxial, circular dies comprises a plurality of wedge-shaped elements, and in which said expanding means comprises a cam having a first frusto-conical surface for urging the wedge-shaped elements of the first and second dies radially outwardly, a second frusto-conical surface for urging the wedge-shaped elements of the third die radially outwardly, lands for engaging the wedge-shaped elements of the first and third dies and maintaining the first and third dies at fixed radial positions while the first frusto-conical surface of the cam continues to urge the wedge-shaped elements of the second die radially outwardly.

9. Apparatus according to claim 6 in which the pressing and rotating means comprises a fixed supporting frame, means for rotating said die head, relative to the supporting frame, about an axis with which the die elements are coaxial, and means for mounting said roller on the frame and for moving the roller radially toward said die head while limiting movement of the roller to rotation and radial movement and preventing revolving movement of the roller about said axis.

10. Apparatus according to claim 6 in which the die head has a fourth circular die spaced axially from, but coaxial with, said first, second and third circular dies, and a second roller opposed to, and cooperable with, said fourth die for forming a reduced neck in a drum blank.

* * * * *

UNITED STATES PATENT AND TRADEMARK OFFICE

CERTIFICATE OF CORRECTION

PATENT NO. : 5,950,472

DATED : September 14, 1999

INVENTOR(S) : Grotnes et al.

It is certified that error appears in the above-indentified patent and that said Letters Patent is hereby corrected as shown below:

Title page, item [73] Assignee:

"Grothes" should read --Grotnes--.

Signed and Sealed this

Eleventh Day of April, 2000

*Attest:*

*Attesting Officer*

Q. TODD DICKINSON

*Director of Patents and Trademarks*